US010283077B2

(12) United States Patent
Song

(10) Patent No.: US 10,283,077 B2
(45) Date of Patent: May 7, 2019

(54) DETECTION CIRCUIT, DRIVER INTEGRATED CIRCUIT AND DETECTION METHOD THEREOF

(71) Applicant: BOE TECHNOLOGY GROUP CO., LTD., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 294 days.

(21) Appl. No.: 15/214,359

(22) Filed: Jul. 19, 2016

(65) Prior Publication Data

US 2017/0229089 A1 Aug. 10, 2017

(30) Foreign Application Priority Data

Feb. 4, 2016 (CN) ..... 2016 1 0080843

(51) Int. Cl.
*G09G 5/00* (2006.01)
*G09G 3/00* (2006.01)

(52) U.S. Cl.
CPC ..... *G09G 5/003* (2013.01); *G09G 3/00* (2013.01); *G09G 2310/027* (2013.01); *G09G 2320/0693* (2013.01); *G09G 2330/12* (2013.01)

(58) Field of Classification Search
CPC ..... G09G 3/006; G09G 3/292–3/2927; G09G 3/0248; G09G 3/0294; G09G 3/3225; G09G 3/3291; G09G 2300/0814; G09G 2300/12; G09G 2300/043; G09G 2300/0842
See application file for complete search history.

(56) References Cited

U.S. PATENT DOCUMENTS

2010/0164619 A1 7/2010 Kim et al.
2011/0001491 A1 1/2011 Huang et al.
(Continued)

FOREIGN PATENT DOCUMENTS

CN 1877684 A 12/2006
CN 101666830 A 3/2010
(Continued)

OTHER PUBLICATIONS

Office Action received for Chinese Patent Application No. 201610080843.6, dated Dec. 1, 2017, 10 pages (5 pages of English Translation and 5 pages of Office Action).
(Continued)

*Primary Examiner* — William Boddie
*Assistant Examiner* — Jeffrey Parker
(74) *Attorney, Agent, or Firm* — Womble Bond Dickinson (US) LLP

(57) ABSTRACT

The disclosure relates to a detection circuit, a driver integrated circuit and a detection method thereof, for determining a voltage value of a sense line, thereby being advantageous of further determining a value of parasitic capacitance of the sense line. The detection circuit can comprise: a reset module, a charge sharing module and an output module. The reset module can be configured to reset the charge sharing module and the sense line. The charge sharing module can be configured to share charges to the sense line after being reset. The output module can be configured to output the voltage of the sense line after the charges are shared.

10 Claims, 6 Drawing Sheets

(56) References Cited

U.S. PATENT DOCUMENTS

| | | | | |
|---|---|---|---|---|
| 2014/0145996 | A1* | 5/2014 | Sugita | G06F 3/044 345/173 |
| 2016/0071445 | A1* | 3/2016 | Kim | G09G 3/006 345/212 |
| 2016/0148563 | A1* | 5/2016 | Tsuge | G09G 3/3225 345/76 |
| 2016/0356832 | A1 | 12/2016 | Lee | |
| 2017/0053590 | A1* | 2/2017 | Song | G01R 19/1659 |
| 2017/0229089 | A1 | 8/2017 | Song | |

FOREIGN PATENT DOCUMENTS

| | | | |
|---|---|---|---|
| CN | 101794561 | A | 8/2010 |
| CN | 103778895 | A | 5/2014 |
| CN | 104216580 | A | 12/2014 |
| CN | 104700761 | A | 6/2015 |
| CN | 104838278 | A | 8/2015 |
| KR | 10-1577909 | B1 | 12/2015 |
| TW | 201102668 | A | 1/2011 |
| TW | 201419251 | A | 5/2014 |

OTHER PUBLICATIONS

Office Action received for Chinese Patent Application No. 201610080843.6, dated May 22, 2018, 11 pages (5 pages of English Translation and 6 pages of Office Action).

Office Action received for Chinese Patent Application No. 201610080843.6, dated Nov. 23, 2018, 22 pages (13 pages of English Translation and 9 pages of Office Action).

* cited by examiner

DETECTION CIRCUIT, DRIVER INTEGRATED CIRCUIT AND DETECTION METHOD THEREOF

RELATED APPLICATIONS

The present application claims the benefit of Chinese Patent Application No. 201610080843.6, filed on Feb. 4, 2016, the entire disclosure of which is incorporated herein by reference.

TECHNICAL FIELD

The disclosure relates to the field of display technology, particularly to a detection circuit, a driver integrated circuit and a detection method thereof.

BACKGROUND ART

Due to limitations of filming and etching processes, each sense line in the display panel has a different parasitic capacitance value. As estimated, the maximum variance of the parasitic capacitance generated by the sense line can reach 50%. Generally, the parasitic capacitance of every sense line will be utilized in the external compensation voltage detection method. Since the parasitic capacitance of each sense line is different, the detection result of detecting the current-voltage characteristics of a thin film transistor (TFT) will be affected, thereby resulting in imprecision of the result. Therefore, before detecting the TFT characteristics, it is required to determine values of parasitic capacitances of different sense lines, and further perform calibration to them.

To sum up, how to detect the parasitic capacitance of the sense line is a technical problem to be urgently solved in the art

SUMMARY

The disclosure provides a detection circuit, a driver integrated circuit (IC) and a detection method thereof, for determining a voltage value of a sense line, thereby being advantageous of further determining a value of parasitic capacitance of the sense line.

According to an aspect, there is provided a detection circuit for detecting a voltage of a sense line. The detection circuit can comprise: a reset module, a charge sharing module and an output module. The reset module can be configured to reset the charge sharing module and the sense line. The charge sharing module can be configured to share charges to the sense line after being reset. The output module can be configured to output the voltage of the sense line after the charges are shared.

In an embodiment, the reset module comprises a first input terminal, a second input terminal, a first output terminal and a second output terminal. The first input terminal is connected to a signal input terminal of a first signal, the second input terminal is connected to a signal input terminal of a second signal, the first output terminal is connected to the sense line, the second output terminal is connected to an input terminal of the charge sharing module. The charge sharing module further comprises an output terminal connected to the sense signal line. The output module comprises an input terminal connected to the sense line and an output terminal connected to an output terminal of the detection circuit. The first signal is a DC voltage signal of a low level, the second signal is a DC voltage signal of a high level.

In an embodiment, the reset module comprises:

a first switch unit, a first terminal of the first switch unit serving as the first input terminal of the reset module, a second terminal of the first switch unit serving as the first output terminal of the reset module; and a second switch unit, a first terminal of the second switch unit serving as the second input terminal of the reset module, a second terminal of the second switch unit serving as the second output terminal of the reset module.

In an embodiment, the charge sharing module further comprises:

a first capacitor, a first terminal of the first capacitor serving as the input terminal of the charge sharing module, a second terminal of the first capacitor being connected to the ground; and a third switch unit, a first terminal of the third switch unit being connected to the first terminal of the first capacitor, a second terminal of the third switch unit serving as the output terminal of the charge sharing module.

In an embodiment, a capacitance value $C_{sense}$ of the sense line is calculated through the following formula:

$$C_{sense}=C_{ext}*(V_{REFH}-V)/(V-V_{REFL}),$$

wherein $C_{ext}$ is a capacitance value of the first capacitor, $V_{REFL}$ is a voltage value of the first signal, $V_{REFH}$ is a voltage value of the second signal, and V is a voltage value outputted by the output module.

In an embodiment, the output module comprises: a fourth switch unit, a first terminal of the fourth switch unit serving as the input terminal of the output module, a second terminal of the fourth switch unit serving as the output terminal of the output module.

In an embodiment, the detection circuit further comprises: a voltage stabilizing capacitor connected between the sense line and the ground.

According to another aspect, there is provided a driver integrated circuit comprising at least one sense line and at least one detection circuit as stated in any of the above connected with each sense line respectively, wherein each of the at least one detection circuit is configured to detect a voltage of a corresponding sense line.

In an embodiment, the driver integrated circuit further comprises an analog-to-digital converter connected with the output terminal of the at least one detection circuit.

According to another aspect, there is provided a detection method for any one of the driver integrated circuits as stated above, the method comprising:

in a reset phase, resetting the charge sharing module and the sense line through the reset module;

in a charge sharing phase, sharing charges in the charge sharing module to the sense line after the resetting;

in an output phase, outputting the voltage of the sense line through the output module after the charges are shared.

In an embodiment, the charge sharing module comprises a first capacitor, a first terminal of the first capacitor serving as the input terminal of the charge sharing module, a second terminal of the first capacitor being connected to the ground. The method further comprises: determining a capacitance value of the sense line based on voltage values of the first signal and the second signal, a capacitance value of the first capacitor and a voltage value outputted by the output terminal.

In an embodiment, determining a capacitance value of the sense line comprises calculating a capacitance value $C_{sense}$ of the sense line through the following formula:

$$C_{sense}=C_{ext}*(V_{REFH}-V)/(V-V_{REFL}),$$

wherein $C_{ext}$ is a capacitance value of the first capacitor, $V_{REFL}$ is a voltage value of the first signal, $V_{REFH}$ is a voltage value of the second signal, and V is a voltage value outputted by the output module.

Embodiments of this disclosure can achieve at least one of the following beneficial effects and/or other beneficial effects:

Some embodiments provide a detection circuit, a driver integrated circuit and a detection method thereof. The detection circuit can comprise: a reset module, a charge sharing module and an output module. The reset module can be configured to reset the charge sharing module and the sense line. The charge sharing module can be configured to share charges to the sense line after being reset. The output module can be configured to output the voltage of the sense line after the charges are shared. In the detection circuit provided by these embodiments, the voltage of the sense line after the charges are shared is determined by combined effect of the reset module, the charge sharing module and the output module. Thereby, it will be advantageous of further determining a value of capacitance of the sense line based on the principle of conservation of energy.

BRIEF DESCRIPTION OF DRAWINGS

In order to illustrate the technical solutions of some embodiments more clearly, next, the drawings to be used in the Detailed Description will be introduced briefly. It should be aware that the drawings described below only relate to some embodiments, for the ordinary skilled person in the art, other drawings can also be obtained from these drawings on the premise of not paying any creative work, the other drawings also fall within the scope of the present invention.

DETAILED DESCRIPTION

In order to understand the purposes, technical solutions and advantages of some embodiments more clearly, next, these embodiments will be described in more detail with reference to the drawings and the specific implementations. The ordinary skilled person in the art can be aware that the embodiments described are only a part of rather than all of the embodiments. Based on the embodiments described by this disclosure, the ordinary skilled person in the art can obtain other embodiments on the premise of not paying any creative work. All of the other embodiments obtained belong to the protection scope of the present invention. It should be noted that the embodiments in this text are described for explaining the present invention better, rather than limiting the present invention in any manner.

In some embodiments, a detection circuit, a driver IC and a detection method thereof are provided for determining a voltage value of a sense line, thereby being advantageous of further determining a value of parasitic capacitance of the sense line.

Below, specific implementations of the detection circuit, the driver integrated circuit and the detection method thereof will be illustrated specifically with reference to the drawings.

Figure 1:
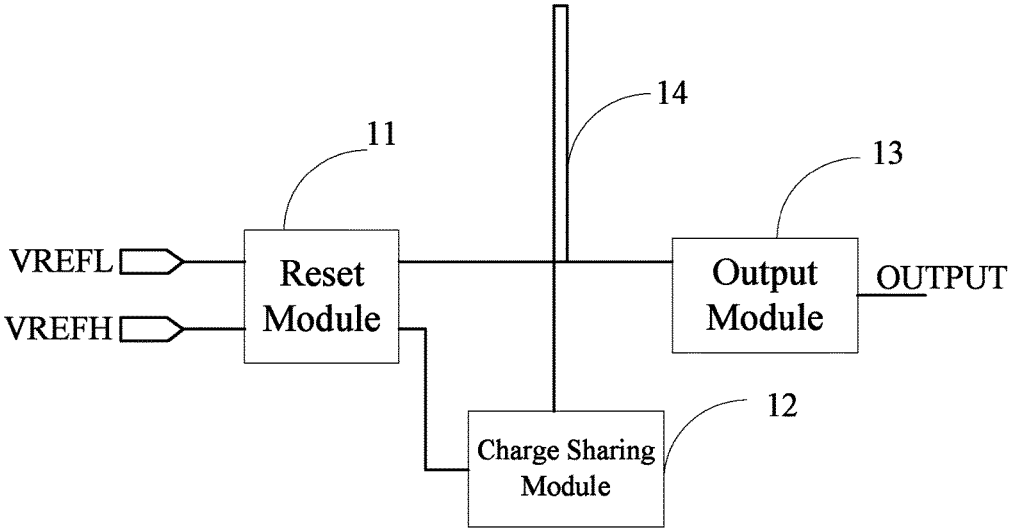
FIG. 1 is a structural schematic view of a detection circuit provided according to an embodiment.

FIG. 1 illustrates a structural schematic view of a detection circuit according to an embodiment. As shown in the figure, the detection circuit can comprise: a reset module 11, a charge sharing module 12 and an output module 13. The reset module 11 can be configured to reset the charge sharing module 12 and the sense line 14. The charge sharing module 12 can be configured to share charges to the sense line 14 after being reset. The output module 13 can be configured to output the voltage of the sense line 14 after the charges are shared.

In the detection circuit provided by the above embodiment, the voltage of the sense line 14 after the charges are shared can be determined by combined effect of the reset module 11, the charge sharing module 12 and the output module 13. Thereby, it will be advantageous of further determining a value of capacitance of the sense line based on the principle of conservation of energy.

In an embodiment, as shown in FIG. 1, the reset module 11 can comprise a first input terminal, a second input terminal, a first output terminal and a second output terminal. The first input terminal of the reset module 11 is connected to a signal input terminal of a first signal $V_{REFL}$, the second input terminal thereof is connected to a signal input terminal of a second signal $V_{REFH}$, the first output terminal thereof is connected to the sense line 14, the second output terminal thereof is connected to an input terminal of the charge sharing module 12. The charge sharing module 12 can further comprise an output terminal connected to the sense line 14. The output module 13 can comprise an input terminal connected to the sense line 14 and an output terminal connected to an output terminal OUTPUT of the detection circuit. The first signal $V_{REFL}$ can be a DC voltage signal of a low level, the second signal $V_{REFH}$ can be a DC voltage signal of a high level.

It should be noted that the above embodiment does not define the voltage values of the first signal $V_{REFL}$ and the second signal $V_{REFH}$ specifically. Specifically, the first signal $V_{REFL}$ is used for providing a voltage signal to the sense line 14, such that the sense line is reset as a voltage value $V_{REFL}$ of the voltage signal, wherein the voltage value of the first signal $V_{REFL}$ can be 0V, but certainly not limited to 0V. The second signal $V_{REFH}$ is used for providing a voltage signal to the charge sharing module, such that the voltage of the charge sharing module becomes into a voltage value $V_{REFH}$ of the voltage signal, wherein the voltage value of the second signal $V_{REFH}$ is greater than the voltage value of the first signal $V_{REFL}$.

Figure 2:
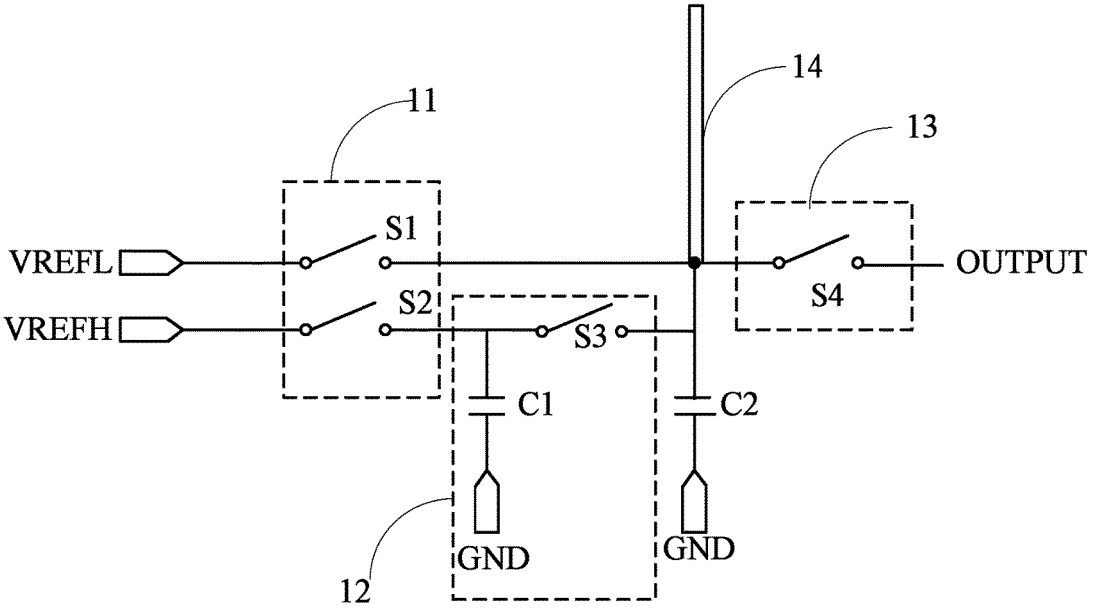
FIG. 2 is a schematic view of a circuit structure of a detection circuit provided according to an embodiment.

FIG. 2 illustrates a schematic view of a circuit structure of a detection circuit provided according to an embodiment. As shown in FIG. 2, the reset module 11 can comprise: a first switch unit S1 and a second switch unit S2. A first terminal of the first switch unit S1 can serve as the first input terminal of the reset module 11, and a second terminal of the first switch unit S1 can serve as the first output terminal of the reset module 11. A first terminal of the second switch unit S2 can serve as the second input terminal of the reset module 11, and a second terminal of the second switch unit S2 can serve as the second output terminal of the reset module 11.

In a specific implementation, the first switch unit S1 and the second switch unit S2 can be any devices with the switch function. For example, the first switch unit S1 and the second switch unit S2 can be thin film transistors TFTs, wherein the thin film transistors can be either N-type transistors or P-type transistors. The above embodiment does not exert any specific limitations in this respect. When the switch unit is a thin film transistor, a source of the thin film transistor can serve as a first terminal of the first or second switch unit, a drain of the thin film transistor can serve as a second terminal of the first or second switch unit. In the reset phase, a control signal can be applied to a gate of the thin film transistor so as to make it conductive between the source and the drain of the thin film transistor. In other phases, a control signal can be applied to the gate of the thin film transistor so as to cut off the source and the drain of the thin film transistor.

In the reset phase in the above operation of the detection circuit, the first switch unit S1 is conductive, so as to provide the first signal $V_{REFL}$ to the sense line 14 through the first output terminal of the reset module 11. The second switch unit S2 is conductive, so as to provide the second signal $V_{REFH}$ to the input terminal of the charge sharing module 12 through the second output terminal of the reset module 11, thereby resetting the voltage. In this way, after the reset phase is completed, the voltage of the sense line 14 is reset as $V_{REFL}$, the voltage of the charge sharing module 12 is reset as $V_{REFH}$.

The above are only illustrations of the circuit structure and operation mode of the reset module 11 in the detection circuit. In specific implementation, the specific structure of the reset module 11 is not limited to the above structure provided by the above embodiment. It can also be other structures known by the ordinary skilled person in the art, which will not be limited here.

In an embodiment, as shown in FIG. 2, the charge sharing module 12 can further comprise a first capacitor C1 and a third switch unit S3. A first terminal of the first capacitor C1 can serve as an input terminal of the charge sharing module 12, and a second terminal of the first capacitor C1 can be connected to the ground GND. A first terminal of the third switch unit S3 can be connected to the first terminal of the first capacitor C1, the second terminal of the third switch unit S3 can serve as an output terminal for the charge sharing module 12.

In a specific implementation, the third switch unit S3 can be any device with the switch function. For example, the third switch unit S3 can be a thin film transitory TFT, wherein the thin film transistor can be either a N-type transistor or a P-type transistor. The above embodiment does not exert any specific limitations in this respect. When the switch unit is a thin film transistor, a source of the thin film transistor can serve as a first terminal of the third switch unit, and a drain of the thin film transistor can serve as a second terminal of the third switch unit. In the charge sharing phase, a control signal can be applied to a gate of the thin film transistor so as to make it conductive between the source and the drain of the thin film transistor. In other phases, a control signal can be applied to the gate of the thin film transistor so as to cut off the source and the drain of the thin film transistor.

In the charge sharing phase in the above operation of the detection circuit, since the third switch unit S3 is conductive at this moment, the charges or electric energy stored by the first capacitor C1 of the charge sharing module 12 in the reset phase can be shared to the sense line 14 through the conductive third switch unit S3, thereby enabling the voltage on the sense line 14 to be equal to the voltage on the first capacitor C1 in the charge sharing module 12.

The above are only illustrations of the circuit structure and the operation mode of the charge sharing module 12 in the detection circuit. In specific implementation, the specific structure of the charge sharing module 12 is not limited to the above structure provided by the above embodiment. It can also be other structures known by the ordinary skilled person in the art, which will not be limited here.

In an embodiment, as shown in FIG. 2, the output module 13 can further comprise a fourth switch unit S4. A first terminal of the fourth switch unit S4 can serve as an input terminal of the output terminal 13, and a second terminal of the fourth switch unit S4 can serve as an output terminal of the output module 13.

In a specific implementation, the fourth switch unit S4 can be any device with the switch function. For example, the fourth switch unit S4 can be a thin film transitory TFT, wherein the thin film transistor can be either a N-type transistor or a P-type transistor. The above embodiment does not exert any specific limitations in this respect. When the switch unit is a thin film transistor, a source of the thin film transistor can serve as a first terminal of the fourth switch unit S4, a drain of the thin film transistor can serve as a second terminal of the fourth switch unit S4. In the output phase, a control signal can be applied to a gate of the thin film transistor so as to make it conductive between the source and the drain of the thin film transistor. In other phases, a control signal can be applied to the gate of the thin film transistor so as to cut off the source and the drain of the thin film transistor.

In the output phase in the above operation of the detection circuit, the voltage on the sense line after the charges being shared can be outputted to the output terminal through the conductive fourth switch unit.

The above are only illustrations of the circuit structure and the operation mode of the output module in the detection circuit. In a specific implementation, the specific structure of the output module 13 is not limited to the above structure provided by the above embodiment. It can also be other structures known by the ordinary skilled person in the art, which will not be limited here.

It should be noted that the first switch unit S1, the second switch unit S2, the third switch unit S3 and the fourth switch unit S4 mentioned in the above embodiments can be either thin film transistors (TFTs) or metal oxide semiconductor field effect transistors (MOS), or simple switches, which will not be limited herein.

In an embodiment, as shown in FIG. 2, the detection circuit can further comprise a voltage stabilizing capacitor C2 connected between the sense line 14 and the ground GND. It should be noted that the function of the voltage stabilizing capacitor is stabilizing the voltage, so that the voltage at the connecting point of the sense line and the output module is stable.

Figure 3:
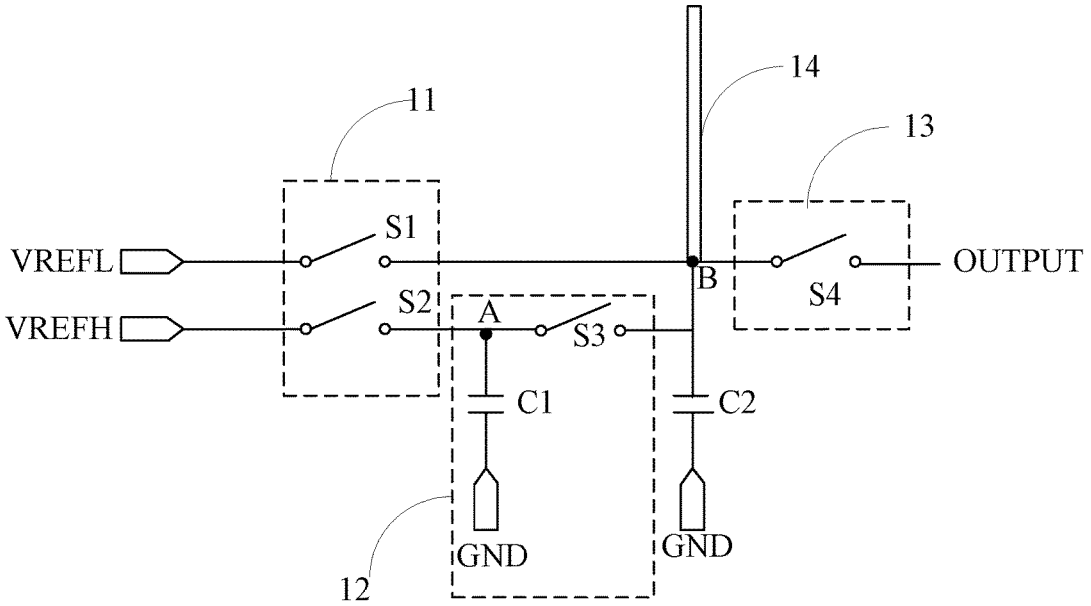
FIG. 3 is a schematic view of a circuit structure of a detection circuit provided according to an embodiment.

FIG. 3 illustrates a schematic view of a circuit structure of a detection circuit provided according to an embodiment. Next, the detection circuit as shown in FIG. 3 is taken as the example to describe the operating process of the detection circuit provided according to an embodiment. For the convenience of describing, it is prescribed that the first terminal of the first capacitor C1 is a first node A, and the first terminal of the voltage stabilizing capacitor C2 is a second node B.

Figure 4:
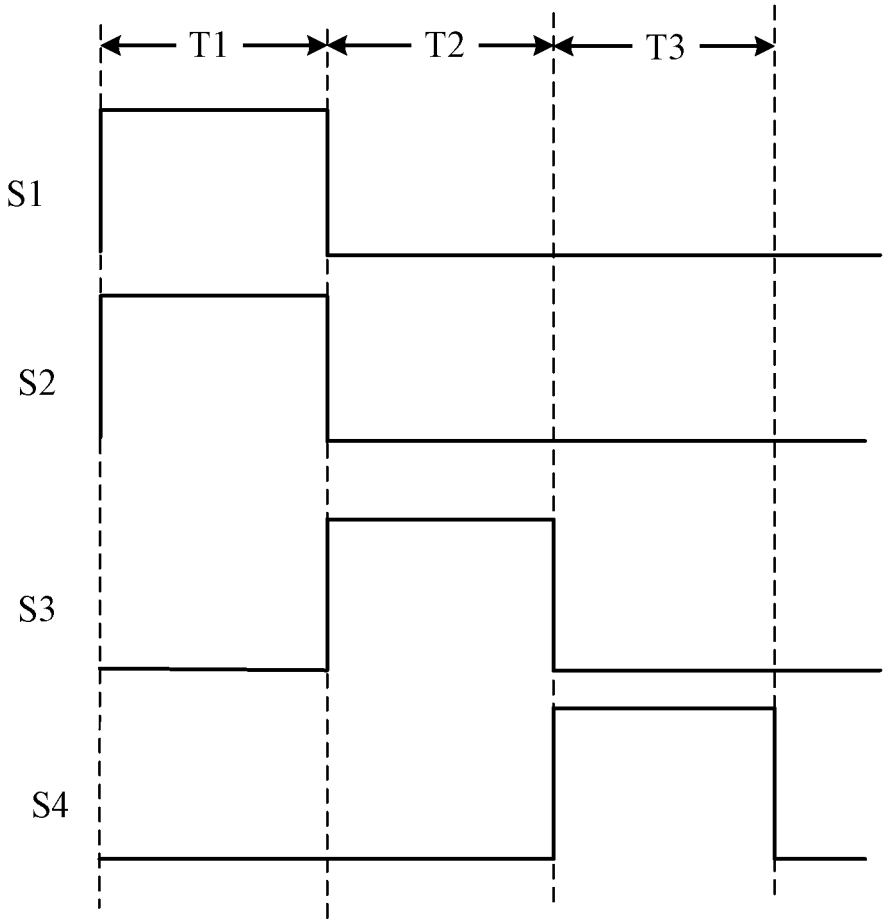
FIG. 4 is a schematic timing diagram of a detection circuit provided according to an embodiment.

FIG. 4 illustrates a schematic timing diagram of a detection circuit provided according to an embodiment. Next, the structure of the detection circuit as shown in FIG. 3 is taken as the example to describe the operating process of the detection circuit with reference to FIG. 4. In the detection circuit as shown in FIG. 3, the corresponding switch unit state is as shown in FIG. 4, wherein the high level is the turn-on state of the switch unit, and the low level is the turn-off state of the switch unit. Specifically, phases T1, T2 and T3 in the state timing diagram as shown in FIG. 4 are selected as examples for detailed description. The phases T1, T2 and T3 correspond to the reset phase, the charge sharing phase and the output phase respectively.

In the phase of T1: the first switch unit S1 and the second switch unit S2 are in the turn-on state, the third switch unit S3 and the fourth switch unit S4 are in the turn-off state. The first switch unit S1 is in the turn-on state to provide the voltage signal of the first signal $V_{REFL}$ to the sense line. The second switch unit S2 is in the turn-on state to provide the voltage signal of the second signal $V_{REFH}$ to the node A of the first capacitor C1 in the charge sharing module. At this moment, the voltage on the sense line is reset as a value of $V_{REFL}$, the voltage value of the node A is a value of $V_{REFH}$.

In the phase of T2: the third switch unit S3 is in the turn-on state, the first switch unit S1, the second switch unit S2 and the fourth switch unit S4 are in the turn-off state. The third switch unit S3 is in the turn-on state to make the conductive connection between the node A and the node B. In this way, the capacitor C1 will share charges stored therein when being reset as a voltage $V_{REFH}$ with the sense line at the voltage $V_{REFL}$, so that the voltage on the sense line, i.e., the voltage at the node B, is changed and will be equal to the voltage at the capacitor C1 or the node A finally.

In the phase of T3: the first switch unit S1, the second switch unit S2 and the third switch unit S3 are turned off, the fourth switch unit S4 is turned on. The fourth switch unit S4 is turned on to output the voltage on the sense line, i.e., the voltage at the node B, to the output terminal.

It should be noted that the capacitance value of the sense line 14 can be further determined based on the schematic diagram of the above detection circuit and the principle of conservation of energy. Specifically, it is assumed that the capacitance value of the first capacitor C1 is $C_{ext}$, the capacitance value on the sense line is $C_{sense}$, and the voltage value of the node B after the charges are shared is V, then it can be derived from the principle of conservation of energy: $(C_{sense}+C_{ext})V=C_{sense}*V_{REFL}+C_{ext}*V_{REFH}$, thereby obtaining the capacitance value of the sense line $C_{sense}=C_{ext}*(V_{REFH}-V)/(V-V_{REFL})$.

Figure 5:
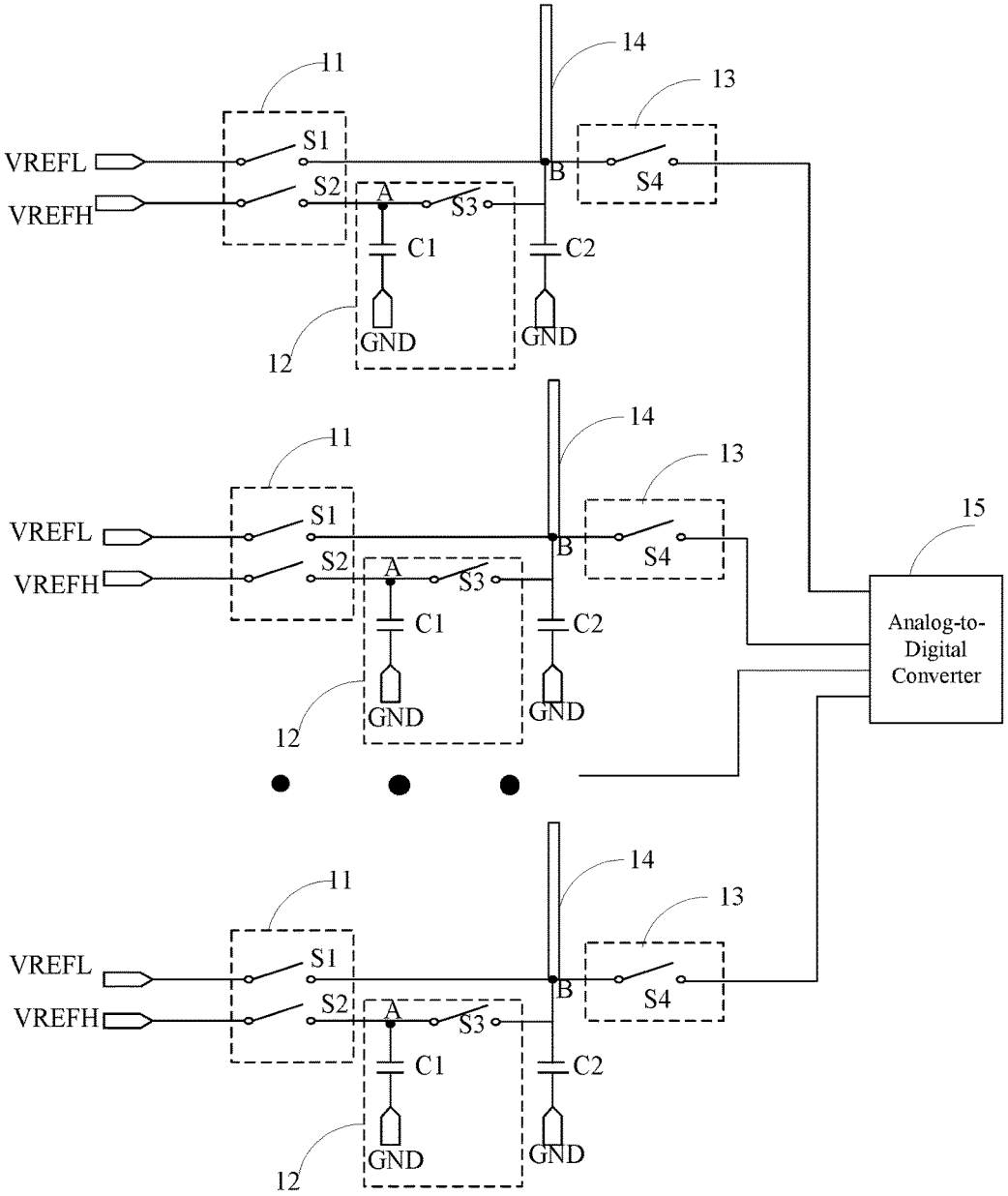
FIG. 5 is a structural schematic view of a driver integrated circuit IC provided according to an embodiment.

FIG. 5 illustrates a structural schematic view of a driver integrated circuit IC provided according to an embodiment. As shown in FIG. 5, the driver IC can comprise at least one sense line, and can further comprise at least one detection circuit as provided by the above embodiments, which at least one detection circuit is connected with each sense line respectively. The principle of the driver IC in solving problems is similar as that of any preceding detection circuit, hence, the implementation of the detection circuit in the driver IC can make reference to the implementation of the detection circuit in the preceding examples, which will not be repeated anymore.

It should be noted that each sense line corresponds to one detection circuit. The structure of each detection circuit is same as the structure of the detection circuit provided by the above embodiments.

In an embodiment, referring to FIG. 5, the driver IC can further comprise: an analog-to-digital converter (ADC) 15 connected with output terminals OUTPUT of a plurality of detection circuits.

FIG. 5 only illustrates that output terminals of three detection circuits are connected to one analog-to-digital converter, however, the ordinary skilled person in the art can understand that it can also include other numbers of detection circuits, which is not limited by the present invention. In addition, the output terminals of all detection circuits in FIG. 5 are connected to the analog-to-digital converter, however, the present invention is not limited to the connecting manner as shown in FIG. 5. Optionally, the output terminal of each detection circuit is connected to one analog-to-digital converter, which also belongs to the protection scope of the present invention.

Figure 6:
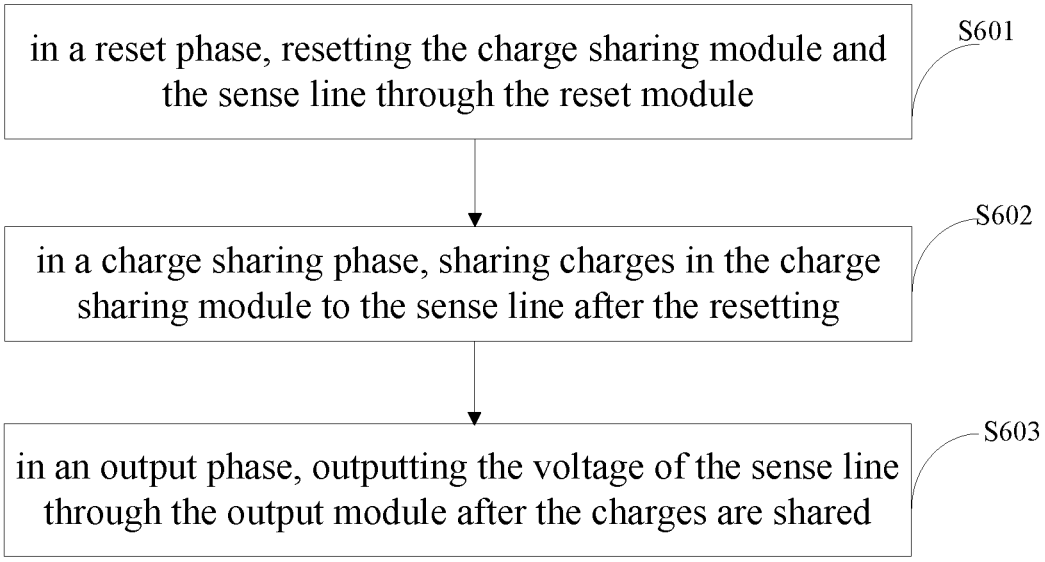
FIG. 6 is a schematic flow chart of a detection method for a driver integrated circuit IC provided according to an embodiment.

FIG. 6 illustrates a schematic flow chart of a detection method for a driver integrated circuit IC provided according to an embodiment. Referring to FIG. 6, the detection method for the driver IC can comprise:

S601, in a reset phase, resetting the charge sharing module and the sense line through the reset module;

S602, in a charge sharing phase, sharing charges in the charge sharing module to the sense line after resetting;

S603, in an output phase, outputting the voltage of the sense line through the output module after the charges are shared.

In an embodiment, the driver IC can be any one of the driver ICs as described above. The first signal and the second signal are used respectively to reset the charge sharing module and the sense line. The charge sharing module can comprise a first capacitor, a first terminal of the first capacitor can serve as an input terminal of the charge sharing module, and a second terminal of the first capacitor can be connected to the ground. The above detection method for a driver IC can further comprise: determining a capacitance value of the sense line based on voltage values of the first signal and the second signal, a capacitance value of the first capacitor and a voltage value outputted by the output terminal.

In an embodiment, determining a capacitance value of the sense line comprises calculating a capacitance value $C_{sense}$ of the sense line through the following formula:

$$C_{sense}=C_{ext}*(V_{REFH}-V)/(V-V_{REFL}),$$

wherein $C_{ext}$ is a capacitance value of the first capacitor, $V_{REFL}$ is a voltage value of the first signal, $V_{REFH}$ is a voltage value of the second signal, and V is a voltage value outputted by the output module.

It should be noted that in the detection circuit connected with each sense line, when the detection method for the driver IC provided by the above embodiment is used, the reset module in the at least one detection circuit can perform resetting simultaneously in the reset phase. In the charge sharing phase, the charge sharing is module in each detection circuit can share the charges therein to the corresponding sense line successively, the chare sharing module in each detection circuit can also share the charges therein to the corresponding sense line simultaneously. In the output phase, the voltages of the sense lines can be outputted through the output modules in a plurality of detection circuits.

Figure 7:
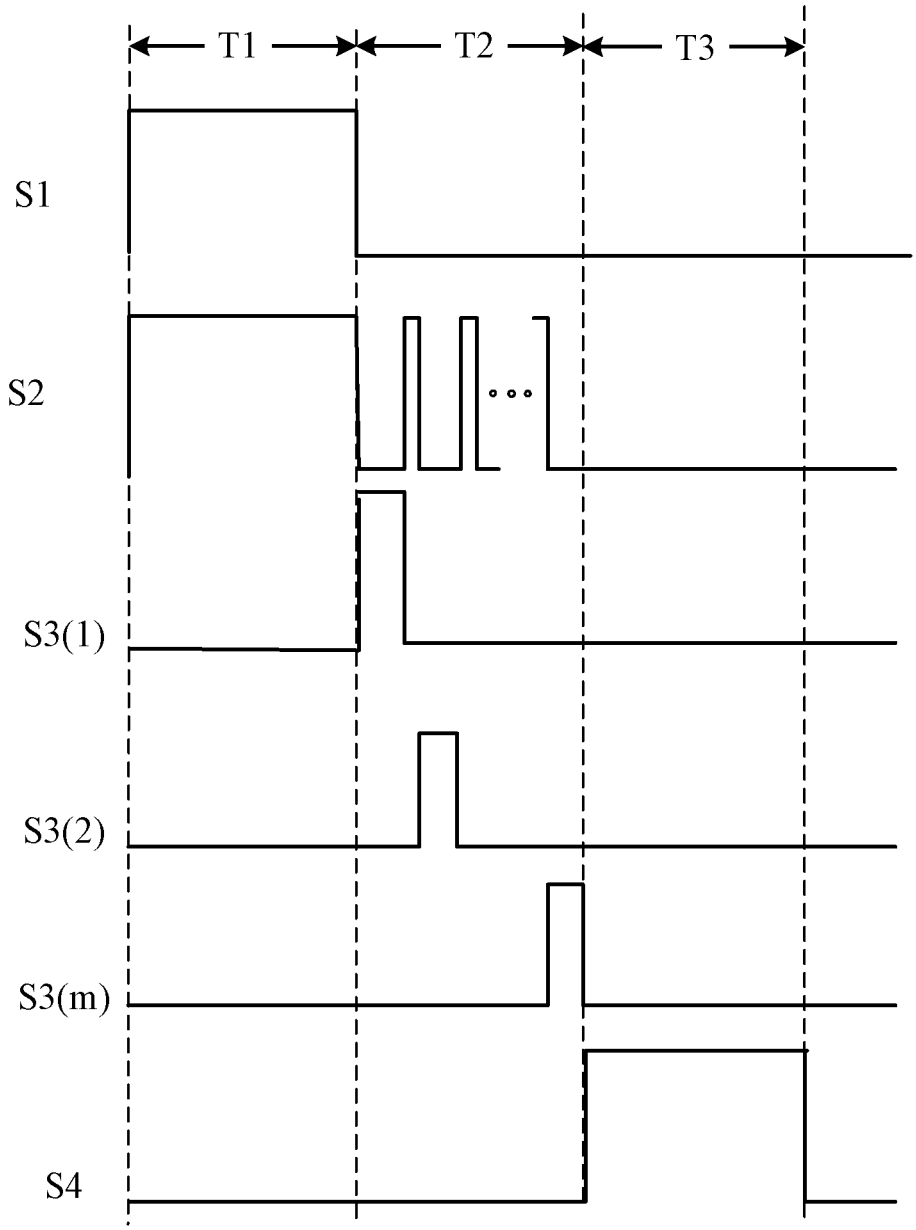
FIG. 7 is a schematic timing diagram of a detection method for a driver integrated circuit IC provided according to an embodiment.

FIG. 7 illustrates a schematic timing diagram of a detection method for a driver integrated circuit IC provided according to an embodiment. Referring to the timing diagram of the turn-on state of the switch unit as shown in FIG. 7, in the charge sharing phase, it is achieved that the charge sharing module in each detection circuit shares the charges therein to the corresponding sense line successively, wherein (l) represents a detection circuit connected with a first sense line, (m) represents a detection circuit connected with the m-th sense line. As shown in FIG. 7, in the charge sharing phase, the second switch unit can continue to apply a second signal to the first capacitor when all the third switch units are turned off, thereby ensuring that the voltage on C1 in the sharing module reaches a predetermined voltage before the charges are shared. Moreover, in this phase, along with successive turn-on of the third switch units S3(1), S3(2) . . . S3(*m*), each sense line shares charges with the first capacitor connected with the sense line successively.

To sum up, a detection circuit, a driver integrated circuit and a detection method thereof are provided according to the above embodiments. The detection circuit can comprise: a reset module, a charge sharing module and an output module. The reset module can be configured to reset the charge sharing module and the sense line. The charge sharing module can be configured to share charges to the sense line after being reset. The output module can be configured to output the voltage of the sense line after the charges are shared. In the detection circuit, the voltage of the sense line after the charges are shared is determined by combined effect of the reset module, the charge sharing module and the output module. Thereby, it will be advantageous of further determining a value of capacitance of the sense line based on the principle of conservation of energy.

It could be understood that what are stated above are only exemplary embodiments of the present invention, but the protection scope of the present invention is not limited thereto. The ordinary skilled person in the art can make various alterations and modifications to the present disclosure without departing from the spirit and the scope of the present invention. Provided that these alterations and modifications belong to the scopes of the claims of the present application and the equivalents thereof, the present invention will be also intended to encompass these alternations and modifications. The protection scope of the present invention should be subject to the protection scopes of the attached claims.

It should be noted that the above embodiments are only illustrated with division of the above functional modules. In actual applications, the above functions can be allocated to and implemented by different functional modules as needed. The internal structure of the device can be divided into different functional modules so as to implement all or part of the functions described above. In addition, the function of one of the above modules can be implemented by a plurality of modules, and the functions of the above plurality of modules can also be integrated into and implemented by one module.

The term "and/or" used in the present application is only used for describing an association relation of associated objects, and represents presence of three relations. For example, "A and/or B" can represent the following three cases: presence of only A, simultaneous presence of both A and B, presence of only B. In addition, the character "/" herein generally represents that the associated objects before and after it are in a relationship of "or".

The wordings such as "first", "second", "third" are used in the present application. Without additional context, use of such wordings does not aim to implying ordering, but actually they are merely used for the purpose of identifying. For example, the phrases "first switch unit" and "second switch unit" do not necessarily mean that the first switch unit is located before the second switch unit in position, nor mean that the first switch unit is operated before the second switch unit in time. Actually, these phrases are only used for identifying different switch units.

In the Claims, any reference signs placed in parentheses should not be construed as limiting the claims. The term "comprise/include" does not exclude presence of elements or steps other than those listed in the claims. The word "a" or "an" before an element does not exclude presence of a plurality of such elements. The present invention may be implemented by means of hardware comprising several distinct elements, and by means of suitably programmed software or firmware, or by means of any combinations thereof.

In a device or system claim enumerating several means, one or more of these means may be embodied by one and the same item of hardware. The mere fact that certain measures are recited in mutually different claims does not indicate that a combination of these measures cannot be used to advantage.

The invention claimed is:

1. A detection circuit for detecting a voltage of a sense line, comprising: a reset module, a charge sharing module and an output module, wherein, the reset module is configured to reset the charge sharing module and the sense line;

the charge sharing module is configured to share charges to the sense line after being reset;

the output module is configured to output the voltage of the sense line after the charges are shared;

wherein the reset module comprises a first input terminal, a second input terminal, a first output terminal and a second output terminal, the first input terminal is connected to a signal input terminal of a first signal, the second input terminal is connected to a signal input terminal of a second signal, the first output terminal is connected to the sense line, and the second output terminal is connected to an input terminal of the charge sharing module;

the charge sharing module comprises an output terminal connected to the sense line and further comprises:

a first capacitor, a first terminal of the first capacitor serving as the input terminal of the charge sharing module, a second terminal of the first capacitor being connected to the ground; and a third switch unit, a first terminal of the third switch unit being connected to the first terminal of the first capacitor, a second terminal of the third switch unit serving as the output terminal of the charge sharing module;

the output module comprises an input terminal connected to the sense line and an output terminal connected to an output terminal of the detection circuit wherein the first signal is a DC voltage signal of a low level, and the second signal is a DC voltage signal of a high level;

wherein a capacitance value $C_{sense}$ of the sense line is calculated through the following formula:

$$C_{sense}=C_{ext}*(V_{REFH}-V)/(V-V_{REFL}),$$

wherein $C_{ext}$ is a capacitance value of the first capacitor, $V_{REFL}$ is a voltage value of the first signal, $V_{REFH}$ is a voltage value of the second signal, and V is a voltage value outputted by the output module.

2. The detection circuit according to claim 1, wherein the reset module comprises:

a first switch unit, a first terminal of the first switch unit serving as the first input terminal of the reset module, a second terminal of the first switch unit serving as the first output terminal of the reset module; and a second switch unit, a first terminal of the second switch unit serving as the second input terminal of the reset module, a second terminal of the second switch unit serving as the second output terminal of the reset module.

3. The detection circuit according to claim 1, wherein the output module comprises:

a fourth switch unit, a first terminal of the fourth switch unit serving as the input terminal of the output module, a second terminal of the fourth switch unit serving as the output terminal of the output module.

4. The detection circuit according to claim 1, wherein the detection circuit further comprises:

a voltage stabilizing capacitor connected between the sense line and the ground.

5. A driver integrated circuit, comprising at least one sense line and at least one detection circuit connected with each sense line respectively, wherein each of the at least one detection circuit is configured to detect a voltage of a corresponding sense line, wherein each detection circuit comprises: a reset module, a charge sharing module and an output module, wherein, the reset module is configured to reset the charge sharing module and the sense line;

the charge sharing module is configured to share charges to the sense line after being reset;

the output module is configured to output the voltage of the sense line after the charges are shared;

wherein the reset module comprises a first input terminal, a second input terminal, a first output terminal and a second output terminal, the first input terminal is connected to a signal input terminal of a first signal, the second input terminal is connected to a signal input terminal of a second signal, the first output terminal is connected to the sense line, and the second output terminal is connected to an input terminal of the charge sharing module;

the charge sharing module comprises an output terminal connected to the sense line and further comprises:

a first capacitor, a first terminal of the first capacitor serving as the input terminal of the charge sharing module, a second terminal of the first capacitor being connected to the ground; and a third switch unit, a first terminal of the third switch unit being connected to the first terminal of the first capacitor, a second terminal of the third switch unit serving as the output terminal of the charge sharing module;

the output module comprises an input terminal connected to the sense line and an output terminal connected to an output terminal of the detection circuit wherein the first signal is a DC voltage signal of a low level, and the second signal is a DC voltage signal of a high level;

wherein a capacitance value $C_{sense}$ of the sense line is calculated through the following formula:

$$C_{sense}=C_{ext}*(V_{REFH}-V)/(V-V_{REFL}),$$

wherein $C_{ext}$ is a capacitance value of the first capacitor, $V_{REFL}$ is a voltage value of the first signal, $V_{REFH}$ is a voltage value of the second signal, V is a voltage value outputted by the output module.

6. The driver integrate circuit according to claim 5, wherein the reset module comprises:

a first switch unit, a first terminal of the first switch unit serving as the first input terminal of the reset module, a second terminal of the first switch unit serving as the first output terminal of the reset module; and a second switch unit, a first terminal of the second switch unit serving as the second input terminal of the reset module, a second terminal of the second switch unit serving as the second output terminal of the reset module.

7. The driver integrate circuit according to claim 5, wherein the output module comprises:

a fourth switch unit, a first terminal of the fourth switch unit serving as the input terminal of the output module, and a second terminal of the fourth switch unit serving as the output terminal of the output module.

8. The driver integrate circuit according to claim 5, wherein the detection circuit further comprises:

a voltage stabilizing capacitor connected between the sense line and the ground.

9. The driver integrate circuit according to claim 5, wherein the driver integrated circuit further comprises: an analog-to-digital converter connected with the output terminal of the at least one detection circuit.

10. A detection method for a driver integrated circuit as claimed in claim 5, the method comprising:

in a reset phase, resetting the charge sharing module and the sense line through the reset module;

in a charge sharing phase, sharing charges in the charge sharing module to the sense line after the resetting;

in an output phase, outputting the voltage of the sense line through the output module after the charges are shared;

wherein the method further comprises:

determining a capacitance value of the sense line based on voltage values of the first signal and the second signal, a capacitance value of the first capacitor and a voltage value outputted by the output terminal;

wherein the determining a capacitance value of the sense line comprises calculating a capacitance value $C_{sense}$ of the sense line through the following formula:

$$C_{sense}=C_{ext}*(V_{REFH}-V)/(V-V_{REFL}),$$

wherein $C_{ext}$ is a capacitance value of the first capacitor, $V_{REFL}$ is a voltage value of the first signal, $V_{REFH}$ is a voltage value of the second signal, V is a voltage value outputted by the output module.

* * * * *